US006609438B1

(12) United States Patent
Bigham et al.

(10) Patent No.: US 6,609,438 B1
(45) Date of Patent: Aug. 26, 2003

(54) ELECTRIC ADJUSTABLE PEDAL SYSTEM WITH TWO-PIECE UPPER ARM

(75) Inventors: Richard Scott Bigham, Kalkaska, MI (US); James Robert Allen, Elmira, MI (US); Todd Alan Fewins, Traverse City, MI (US)

(73) Assignee: Dura Global Technologies, Inc, Rochester Hills, MI (US)

( * ) Notice: Subject to any disclaimer, the term of this patent is extended or adjusted under 35 U.S.C. 154(b) by 0 days.

(21) Appl. No.: 09/642,975

(22) Filed: Aug. 18, 2000

(51) Int. Cl.[7] ..... G05G 1/14
(52) U.S. Cl. ..... 74/560; 74/512
(58) Field of Search ..... 74/512, 560

(56) References Cited

U.S. PATENT DOCUMENTS

| | | | | | |
|---|---|---|---|---|---|
| 3,643,524 | A | | 2/1972 | Herring | |
| 3,643,525 | A | | 2/1972 | Gibas | |
| 3,974,713 | A | * | 8/1976 | Toohey | 192/12 BA |
| 3,975,972 | A | | 8/1976 | Muhleck | |
| 4,497,399 | A | | 2/1985 | Kopich | |
| 4,683,977 | A | | 8/1987 | Salmon | |
| 4,870,871 | A | | 10/1989 | Ivan | |
| 4,875,385 | A | | 10/1989 | Sitrin | |
| 4,989,474 | A | | 2/1991 | Cicotte | |
| 5,010,782 | A | | 4/1991 | Asano | |
| 5,078,024 | A | * | 1/1992 | Cicotte | 74/512 |
| 5,086,663 | A | * | 2/1992 | Asano | 74/512 |
| 5,160,205 | A | * | 11/1992 | Mistyurik | 400/120.16 |
| 5,351,573 | A | | 10/1994 | Cicotte | |
| 5,460,061 | A | | 10/1995 | Redding | |
| 5,632,183 | A | | 5/1997 | Rixon | |
| 5,697,260 | A | | 12/1997 | Rixon | |
| 5,722,302 | A | | 3/1998 | Rixon | |
| 5,771,752 | A | | 6/1998 | Cicotte | |
| 5,819,593 | A | | 10/1998 | Rixon | |
| 5,823,064 | A | * | 10/1998 | Cicotte | 74/512 |
| 5,855,143 | A | | 1/1999 | Ewing | |
| 5,884,532 | A | | 3/1999 | Rixon | |
| 5,890,399 | A | | 4/1999 | Rixon | |
| 5,901,614 | A | | 5/1999 | Ewing | |
| 5,913,946 | A | | 6/1999 | Ewing | |
| 5,927,154 | A | | 7/1999 | Elton | |
| 5,964,125 | A | | 10/1999 | Rixon | |
| 5,996,438 | A | * | 12/1999 | Elton | 74/512 |
| 6,017,090 | A | * | 1/2000 | Bonk | 297/362.12 |
| 6,019,015 | A | * | 2/2000 | Elton | 74/512 |
| 6,070,489 | A | | 6/2000 | Ananthasivan | |
| 6,151,985 | A | * | 11/2000 | Garber | 74/512 |
| 6,367,348 | B1 | * | 4/2002 | Toelke et al. | 74/512 |

* cited by examiner

*Primary Examiner*—Charles A Marmor
*Assistant Examiner*—Eric M Williams
(74) *Attorney, Agent, or Firm*—Richard M. Mescher; Casimir B. Kiczek

(57) ABSTRACT

An adjustable control pedal for a motor vehicle includes an upper arm having first and second substantially parallel and spaced-apart members. The first and second members are rigidly connected together to prevent relative movement therebetween and each have first and second slots formed therein. A lower arm has a lower end carrying a pedal and an upper end extending between the first and second members. A first guide pin is secured to the lower arm and extends into the first slot of the first member and the first slot of the second member. A second guide pin is secured to the lower arm and extends into the second slot of the first member and the second slot of the second member he slots and the guide pins form a sliding two-pin four-slot connection between the upper and lower pedal arms. The guide pins preferably have flat or planar upper and lower engagement surfaces located within the slots. Preferably, polymer bushings are provided which encircle the guide pins within the slots and have flanges which extend between the upper and lower arms. A drive assembly is operatively connected to the lower arm to selectively move the lower arm relative to the first and second upper arms to adjust the position of the pedal relative to the operator of the motor vehicle.

26 Claims, 6 Drawing Sheets

ELECTRIC ADJUSTABLE PEDAL SYSTEM WITH TWO-PIECE UPPER ARM

FIELD OF THE INVENTION

The present invention generally relates to an improved control pedal for a motor vehicle and, more particularly, to a control pedal for a motor vehicle which is selectively adjustable to desired positions.

BACKGROUND OF THE INVENTION

Control pedals are typically provided in a motor vehicle, such as an automobile, which are foot operated by the driver. Separate control pedals are provided for operating brakes and an engine throttle. When the motor vehicle has a manual transmission, a third control pedal is provided for operating a transmission clutch. A front seat of the motor vehicle is typically mounted on tracks so that the seat is forwardly and rearwardly adjustable along the tracks to a plurality of positions so that the driver can adjust the front seat to the most advantageous position for working the control pedals.

This adjustment method of moving the front seat along the tracks generally fills the need to accommodate drivers of various size, but it raises several concerns. First, this adjustment method still may not accommodate all drivers due to very wide differences in anatomical dimensions of drivers. Second, the position of the seat may be uncomfortable for some drivers. Therefore, it is desirable to have an additional or alternate adjustment method to accommodate drivers of various size.

Many proposals have been made to selectively adjust the position of the control pedals relative to the steering wheel and the front seat in order to accommodate drivers of various size. It would be readily apparent to those skilled in the art that these adjustable control pedals can actuate both conventional cable controls and electronic throttle controls (ETC), because the ETC is a function separate from adjustability and the ETC module would typically be positioned remote from the mechanism for adjustment of the control pedals.

U.S. Pat. Nos. 5,632,183, 5,697,260, 5,722,302, 5,819,593, 5,937,707, and 5,964,125, the disclosures of which are expressly incorporated herein in their entirety by reference, each disclose an example of an adjustable control pedal assembly. This control pedal assembly includes a hollow guide tube, a rotatable screw shaft coaxially extending within the guide tube, a nut in threaded engagement with the screw shaft and slidable within the guide tube, and a control pedal rigidly connected to the nut. The control pedal is moved forward and rearward when an electric motor rotates the screw shaft to translate the nut along the screw shaft within the guide tube. While this control pedal assembly may adequately adjust the position of the control pedal to accommodate drivers of various size, this control pedal assembly is relatively complex and expensive to produce. The relatively high cost is particularly due to the quantity of high-precision machined parts such as, for example, the guide tube and due to the quantity of welded joints.

U.S. Pat. Nos. 3,643,525 and 3,643,524, the disclosures of which are expressly incorporated herein in their entirety by reference, each disclose an example of an adjustable control pedal assembly which is much less expensive to produce. This control pedal assembly includes an upper arm having a single horizontal slot, a rotatable screw shaft attached to the upper arm and extending along the slot, a nut in threaded engagement with the screw shaft and having a pin slidable within the slot, and a control pedal rigidly connected to the nut. The control pedal is moved forward and rearward when an electric motor rotates the screw shaft to translate the nut along the screw shaft. While this control pedal assembly may adequately adjust the position of the control pedal to accommodate drivers of various size and is relatively inexpensive to produce, this control pedal is relatively unstable and can have a relatively large amount of lash. That is, components of the control pedal are subject to vibration during regular operation of the motor vehicle causing the components to rub or strike together causing undesirable noise.

Accordingly, there is a need in the art for an adjustable control pedal assembly which selectively adjusts the position of the pedal to accommodate drivers of various size, is relatively simple and inexpensive to produce, has a stable control pedal, has a relatively low amount of lash, and is highly reliable to operate.

SUMMARY OF THE INVENTION

The present invention provides an ad!justable control pedal for a motor vehicle which overcomes at least some of the above-noted problems of the related art. According to the present invention, an adjustable control pedal includes, in combination, an upper arm having first and second generally planar members. The first and second members are generally parallel and spaced apart. A lower arm has la lower end carrying a pedal and an upper end extending between the first and second members and operatively connected to the upper arm for selected movement relative to the upper arm. A drive assembly is operatively connected to the lower arm to selectively move the lower arm relative to the upper arm.

According to another aspect of the present invention, an adjustable control pedal includes, in combination, an upper arm having first and second spaced-apart members. The first and second members each have a slot formed therein. A lower arm has a lower end carrying a pedal and an upper end extending between the first and second members. A guide pin is secured to the lower arm and extends into the slot of the first member and the slot of the second member. Bushings encircle the guide pin within the slot of the first member and the slot of the second member. A drive assembly is operatively connected to the lower arm to selectively move the lower arm relative to the upper arm.

According to yet another aspect of the present invention, an adjustable control pedal includes, in combination, an upper arm having first and second spaced-apart members. The first and second members each have first and second slots formed therein. A lower arm has a lower end carrying a pedal and an upper end extending between the first and second members. A first guide pin is secured to the lower arm and extends into the first slot of the first member and the first slot of the second member. A second guide pin is secured to the lower arm and extends into the second slot of the first member and the second slot of the second member. A drive assembly is operatively connected to the lower arm to selectively move the lower arm relative to the upper arm.

From the foregoing disclosure and the following more detailed description of various preferred embodiments it will be apparent to those skilled in the art that the present invention provides a significant advance in the technology and art of adjustable control pedal assemblies. Particularly significant in this regard is the potential the invention affords for providing a high quality, feature-rich, low cost assembly. Additional features and advantages of various preferred embodiments will be better understood in view of the detailed description provided below.

BRIEF DESCRIPTION OF THE DRAWINGS

These and further features of the present invention will be apparent with reference to the following description and drawings, wherein.

Figure 2:
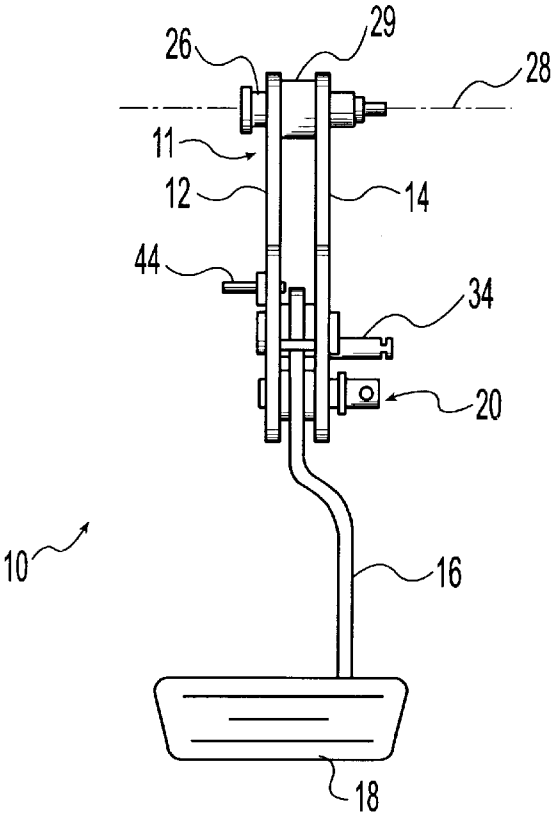
FIG. 2 is a rear elevational view of the adjustable control pedal of FIG. 1.
Figure 1:
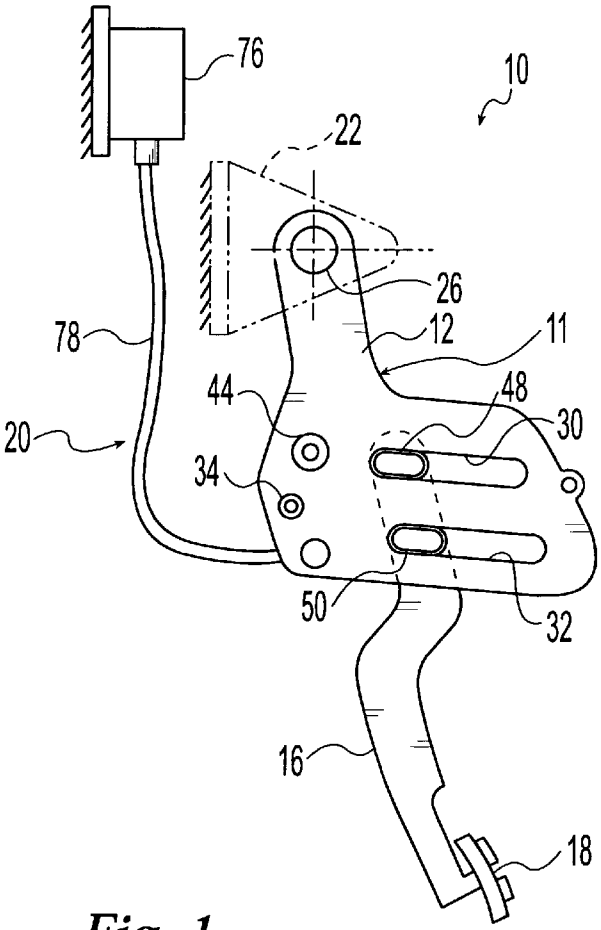
FIG. 1 is a left side elevational view of an adjustable control pedal according a first embodiment of the present invention.
Figure 3:
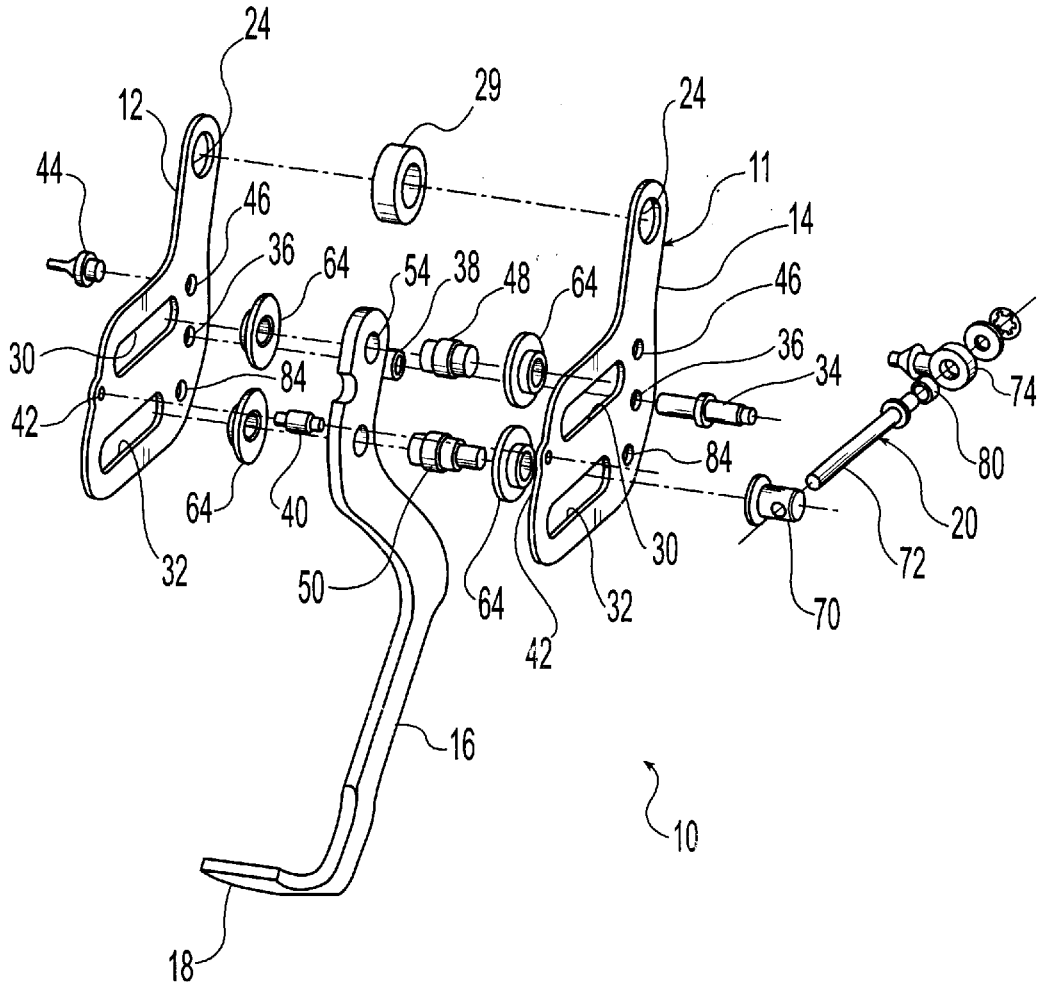
FIG. 3 is an exploded elevational view of the adjustable control pedal of FIGS. 1 and 2.
Figure 4:
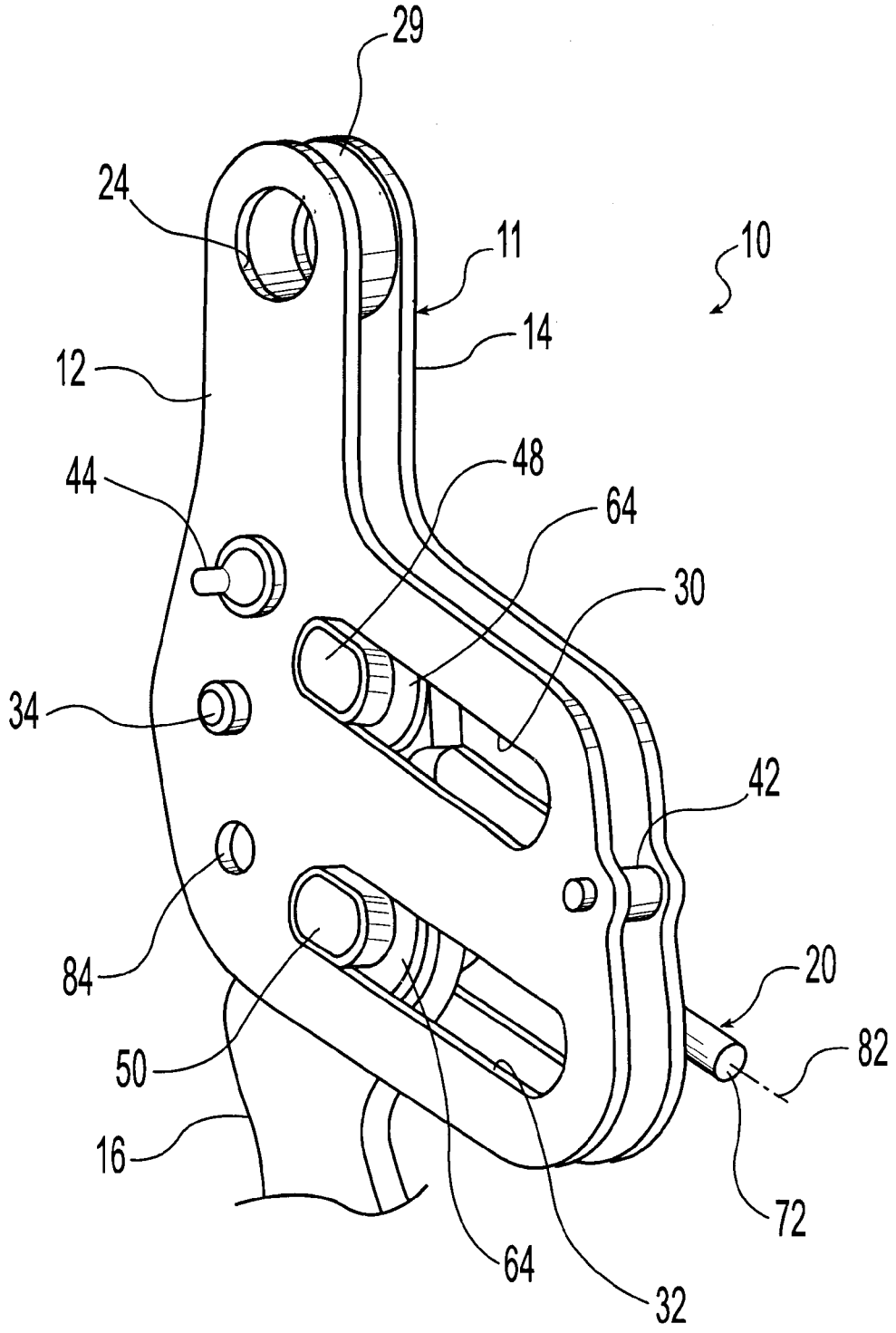
FIG. 4 is an enlarged left perspective view of an upper portion of the adjustable control pedal of FIGS. 1 to 3.
Figure 5:
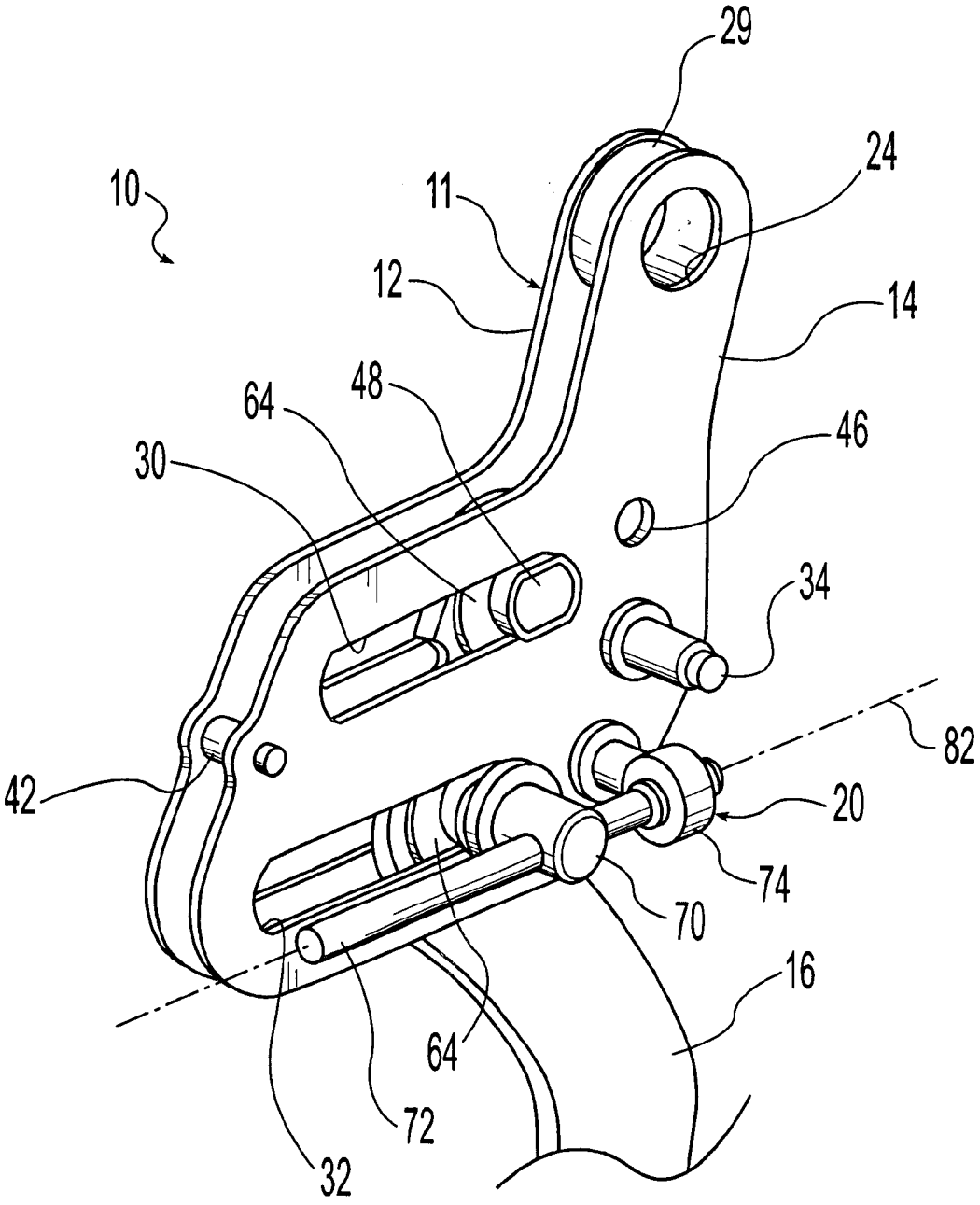
FIG. 5 is an enlarged right side perspective view of an upper portion of the adjustable control pedal of FIGS. 1 to 4.
Figure 6:
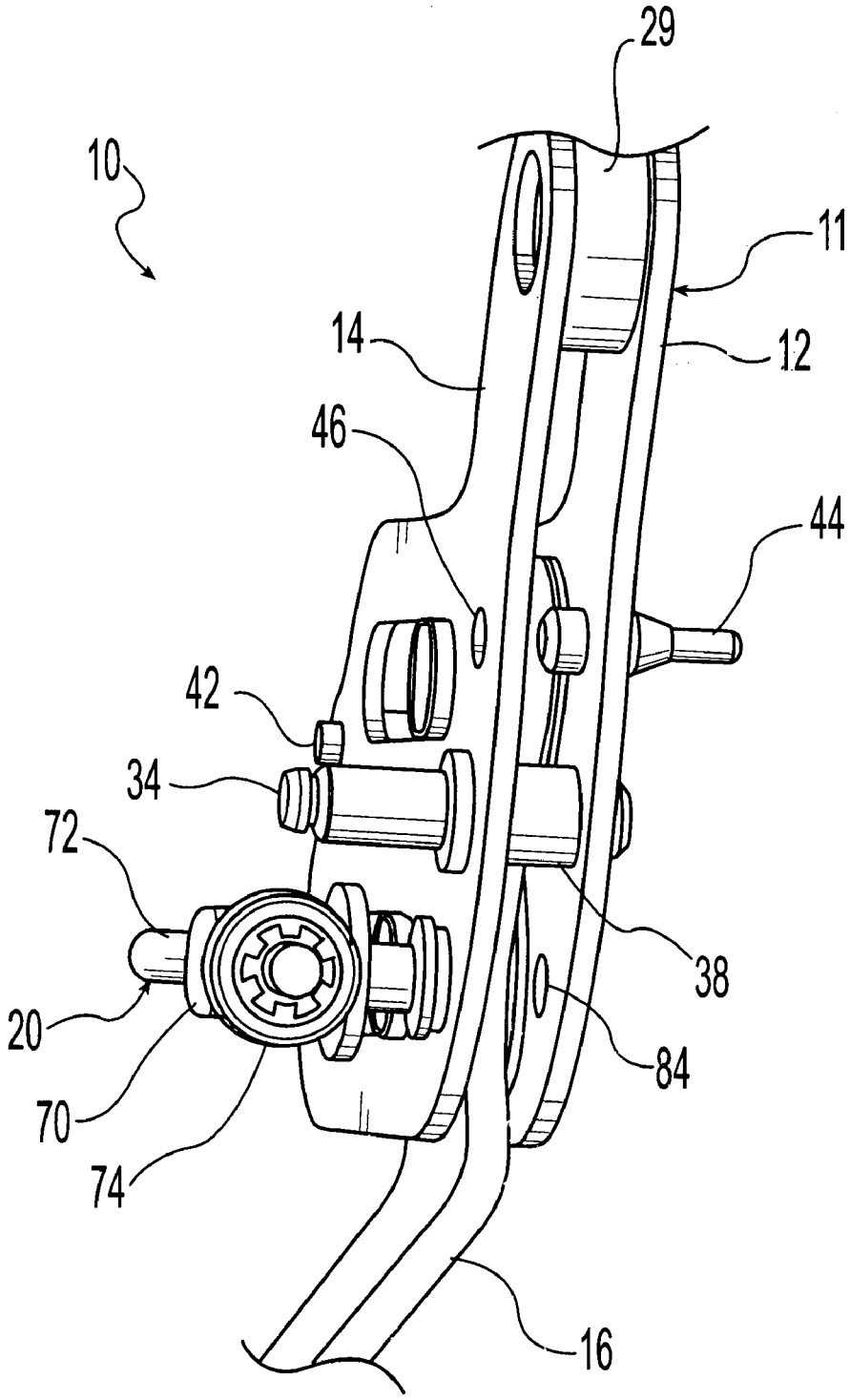
FIG. 6 is a perspective front view of the upper portion of the adjustable control pedal of FIGS. 1 to 5.

It should be understood that the appended drawings are not necessarily to scale, presenting a somewhat simplified representation of various preferred features illustrative of the basic principles of the invention. The specific design features of an adjustable control pedal as disclosed herein, including, for example, specific dimensions, orientations, and shapes of the pedal arms and the slots will be determined in part by the particular intended application and use environment. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the control pedal assembly illustrated in the drawings. In general, up or upward refers to an upward direction in the plane of the paper in FIGS. 1 and 2 and down or downward refers to a downward direction in the plane of the paper in FIGS. 1 and 2. Also in general, fore or forward refers to a direction toward the front of the motor vehicle, that is, to the left in the plane of the paper in FIG. 1 and aft or rearward refers to a direction toward the rear of the motor vehicle, that is, to the right in the plane of the paper in FIG. 1.

DETAILED DESCRIPTION OF CERTAIN PREFERRED EMBODIMENTS

It will be apparent to those skilled in the art, that is, to those who have knowledge or experience in this area of technology, that many uses and design variations are possible for the improved adjustable control pedal disclosed herein. The following detailed discussion of various alternative and preferred embodiments will illustrate the general principles of the invention with reference to an adjustable control pedal for use with a motor vehicle. Other embodiments suitable for other applications will be apparent to those skilled in the art given the benefit of this disclosure.

Referring now to the drawings, FIGS. 1 to 6 show an adjustable control pedal 10 for a motor vehicle, such as an automobile, according to a first embodiment of the present invention which is selectively adjustable to a desired forward/rearward position by a motor vehicle operator or driver. While the illustrated embodiments of the present invention are particularly adapted for use with an automobile, it is noted that the present invention can be utilized with any vehicle having at least one foot operated control pedal including trucks, buses, vans, recreational vehicles, earth moving equipment and the like, off road vehicles such as dune buggies and the like, air borne vehicles, and water borne vehicles.

The illustrated adjustable control pedal 10 is adapted as a brake pedal but it is noted that adjustable control pedal 10 can alternatively be adapted as a clutch, accelerator, or other desired pedal within the scope of the present invention. While a single adjustable control pedal 10 is illustrated, it is also noted that two control pedals 10 can be utilized together within the scope of the present invention such as, for example, control pedals 10 adapted as brake and accelerator pedals respectively. It is further noted more than two control pedals can be utilized together within the scope of the present invention such as, for example, three control pedals 10 adapted as clutch, brake and accelerator pedals respectively. The control pedal 10 is selectively adjustable by the motor vehicle operator in a forward/rearward direction as described in more detail hereinafter. When more than one adjustable control pedal 10 is utilized, the control pedals 10 are preferably adjusted together simultaneously to maintain desired relationships between the control pedals 10 such as, for example, "step over", that is, the forward position of the accelerator pedal relative to the brake pedal, and "pedal angles", that is, the orientation of the contact surfaces of the pedal pads. It is noted however, that individual adjustment of a single control pedal 10 is within the scope of the present invention.

The control pedal 10 includes an upper arm 11 having first and second plates or members 12, 14, a lower pedal arm 16 supported by the first and second members 12, 14 and carrying a pad or pedal 18 for engagement by the foot of the motor vehicle operator, and a drive assembly 20 for moving of the lower pedal arm 14 relative to the upper pedal arm 11 to adjust the position of the pedal 18. The upper pedal arm 11 is sized and shaped for pivotal attachment to a mounting bracket 22. The mounting bracket 20 is adapted to rigidly attach the adjustable control pedal 10 to a firewall or other rigid structure of the motor vehicle in a known manner. The upper pedal arm 11 is adapted for pivotal attachment to the mounting bracket 22. The illustrated first and second members 12, 14 of the upper pedal arm 11 each have an opening 24 formed for cooperation with the mounting bracket 22 and an axle or pivot pin 26. With the pivot pin 26 extending through the mounting bracket 22 and the openings 24 of the first and second members 12, 14, the upper pedal arm is pivotable relative to the fixed mounting bracket 22 about a horizontally and laterally extending pivot axis 28 formed by the central axis of the pivot pin 26. A spacer 29 is provided about the pivot pin 26 between the first and second members 12, 14 to maintain a desired distance between the first and second members 12, 14.

The illustrated first and second members 12, 14 of the upper pedal arm 11 are substantially identical and are rigidly connected together to pivot together about the pivot pin 26 in unison. Each first and second member 12, 14 is an elongate plate oriented in a vertical plane. The first and second members 12, 14 are laterally spaced apart to form a space therebetween for receipt of the lower pedal arm 16. The first and second members 12, 14 are preferably formed of a suitable metal such as steel but can alternatively be formed of other suitable materials such as, for example, plastics like NYLON, aluminum, or magnesium. The illustrated first and second members 12, 14 are generally "L-shaped" having a generally vertical upper portion which generally extends downward from the pivot axis 28 and a generally horizontal lower portion which generally extends in a rearward direction from a lower end of the upper portion. The upper portion of the first and second members 12, 14 is adapted for pivotal attachment to the mounting bracket 22 as described hereinabove. The illustrated opening 24 is located near the top of the upper portion but the opening 24 can have other suitable locations on the first and second members 12, 14 within the scope of the present invention.

The lower portion of the first and second members 12, 14 is adapted for supporting the lower pedal arm 16 and for selected fore and aft movement of the lower pedal arm 16 relative to the first and second members 12, 14 along the lower portion as described in more detail hereinafter. The illustrated lower portion has a pair of vertically spaced apart elongate openings or slots 30, 32 formed therein which generally extend in a forward/rearward direction along the length of the lower portion. The illustrated slots 30, 32 are each substantially straight. Preferably, the drive or lower slot 32 is offset rearward of the guide or upper slot 30 but overlapping the upper slot 30. The lower portion is substantially planar or flat at least in the areas adjacent the slots 30, 32 and the slots 30, 32 are open laterally through the entire thickness of the first and second members 12, 14. The slots 30, 32 are sized and shaped for cooperation with the lower pedal arm 16 for substantially linear forward/rearward movement of the pedal 18 relative the upper pedal arm 11 over a desired adjustment range, such as about three inches, as described in more detail hereinbelow. It is noted that the separate upper and lower slots 30, 32 can alternatively be separate portions of a single slot such as a "C-shaped", "S-shaped", or other nonlinear slot.

The upper pedal arm 11 is operative y connected to a control device such as a clutch, brake or throttle such that pivotal movement of the upper pedal arm 11 about the pivot axis 28 operates the control device in a desired manner. The upper pedal arm 11 can be connected to the control device by, for example, a push-pull or Bowden cable for mechanical actuation or by a sensor and electrical wire or cable for electronic actuation. The illustrated upper pedal arm 11 is provided with a booster pin 34 for connection to the control device by a mechanical actuator. The illustrated booster pin 34 extends through openings 36 in each of the first and second members 12, 14 and secures the first and second members 12, 14 together. Alternatively, the booster pin 34 can extend through only one of the first and second members 12, 14 if other means for connecting the first and second members 12, 14 together is provided. A spacer 38 is provided to maintain a desired distance between the first and second members 12, 14. The illustrated booster pin 34 is rigidly secured by staking but other suitable connections can be utilized such as, for example, welding, spring clips, a snap-fit connection, or threaded connection. The illustrated booster pin 34 is located at the forward end of the first and second members 12, 14 and vertically between the guide slots 30, 32. Other suitable locations for the booster pin 34 can be utilized within the scope of the present invention.

A spacer pin 40 extends through openings 42 in each of the first and second members 12, 14 and secures the first and second members 12, 14 together. The illustrated spacer pin has a central portion sized and shaped for spacing the first and second members 12, 14 apart a desired distance and opposed end portions sized for extending through the openings 42. The illustrated spacer pin 40 is rigidly secured by staking the end portions but other suitable connections can be alternatively utilized such as, for example, welding, spring clips, a snap-fit connection, or threaded connection. The illustrated spacer pin 40 is located at the rearward end of the first and second members 12, 14 and vertically between the guide slots 30, 32 generally opposite the booster pin 34. Other suitable locations for the spacer pin 40 and additional spacer pins 40 can be utilized within the scope of the present invention The illustrated upper pedal arm 11 is also provided with a switch pin 44 for connection to a switch for indicator lights such as brake lights such that the indicator lights indicate actuation, that is pivotal movement about the pivot axis 28, of the control pedal 10 by the operator. The illustrated switch pin 44 extends through an opening 46 in the first or left member 12. The switch pin 44 is rigidly secured by staking but can alternatively be secured in any suitable manner such as, for example, welding, spring clips, a snap-fit connection, or a threaded connection such as a nut. Alternatively, the switch pin 36 can extend through both of the first and second members 12, 14 to additionally connect the first and second members 12, 14 together.

The lower pedal arm 16 is preferably formed of a suitable metal such as steel but one or both can alternatively be formed of other suitable materials such as, for example, plastics like NYLON, aluminum, or magnesium. The illustrated lower pedal arm 16 is formed of an elongate plate oriented in a vertical plane substantially parallel to planes of the first and second members 12, 14. The upper end of the lower pedal arm 16 is adapted for movement relative to the upper pedal arm 11 between first and second members 12, 14 and along the upper and lower slots 30, 32. The upper end of the lower pedal arm 16 is provided with upper and lower guide pins or blocks 48, 50 laterally and horizontally extending therefrom to cooperate with the slots 30, 32 of the first and second members 12, 14 to form four sliding pin-and-slot connections for linearly moving the lower pedal arm 16 relative to the upper pedal arm 11. The lower end of the lower pedal arm 16 is sized and shaped to carry the rearward-facing pedal 18. The pedal 18 is adapted for depression by the driver of the motor vehicle to pivot the control pedal 10 about the pivot axis 28 to obtain a desired control input to the motor vehicle through the movement of the booster pin 34.

Figure 7:
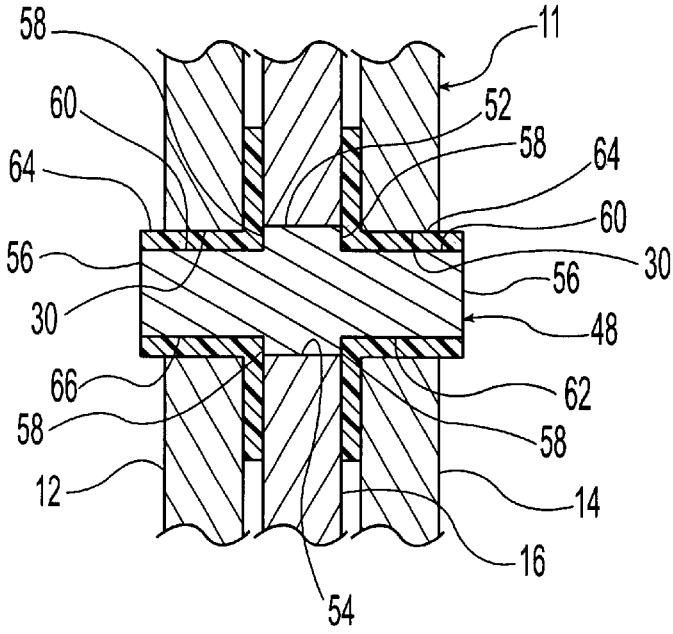
FIG. 7 is a cross-sectional view taken along an upper guide pin of the adjustable control pedal of FIG. 2.

As best shown in FIG. 7, the illustrated upper guide pin 48 has a central portion 52 sized for cooperating with an opening 54 in the lower pedal arm 16 and opposed end portions 56 sized for cooperating with the upper slots 30 in the first and second members 12, 14 as described in more detail hereinafter. The central portion 52 is preferably sized to freely rotate relative to the lower pedal arm 16. When the slots 0, 32 are not parallel, the guide pins 48, 50 must rotate within the slots 30, 32, or within the openings 54 of the lower pedal arm 16. Because the illustrated embodiment of the guide pins 48, 50 has flat engagement surfaces, as described hereinbelow, the guide pins 48, 50 must rotate in the lower pedal arm 16 because they cannot rotate within the slots 30, 32. It is noted, however, that in other embodiments the guide pins 48, 50 can alternatively be rigidly secured to the lower pedal arm 16 and rotate within the slots 30, 32. The upper guide pin 48 is preferably retained within the lower pedal arm 16 by engaging the first and second members 12, 14 as described in more detail hereinafter.

Figure 9:
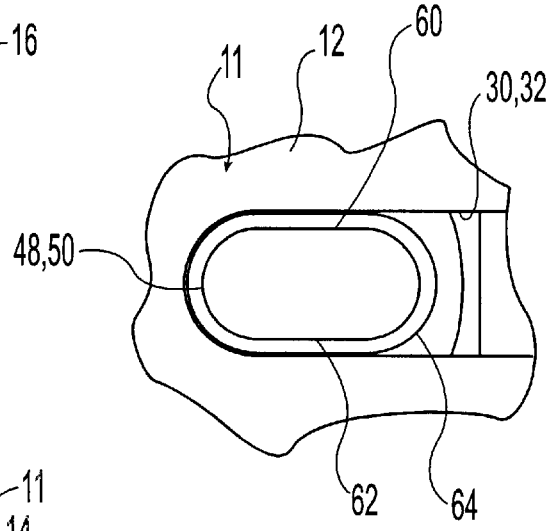
FIG. 9 is a fragmented, enlarged left elevational view showing a guide pin with bushing of the adjustable control pedal of FIGS. 1–8.

The end portions 56 are preferably sized smaller than the central portion 52 to form outward facing abutments 58. The abutments 58 enable the central portion 52 to act as a spacer to maintain the desired distance between the first and second members 12, 14. The end portions 56 are preferably provided with upper and lower engagement surfaces 60, 62 which are substantially flat or planar (best shown in FIG. 9). The end portions 56 are also sized and shaped to cooperate with bushings 64 which encircle the end portions 56 and extend within the slots 30, 32. The bushings 64 are sized and shaped to closely conform with the end portions 56, particularly at the upper and lower engagement surfaces 60, 62. The end portions 56 and bushings 64 are sized and shaped so that there is very little or no vertical movement or "play" for the guide pins 48, 50 within the slots 30, 32. Flanges 66 of the bushings 64 are sized to extend between the lower pedal arms 16 and the first and second members 12, 14 and to engage the first and second members 12, 14 adjacent the upper slots 30. The flanges 66 are sized and shaped so that there is very little or no lateral movement or "play" for the lower pedal arm 16 between the first and second members 12, 14. The bushings 64 are preferably formed of a suitable plastic or polymer material but can alternatively be any other type of suitable wear resistant and/or low friction material. It is noted that the bushings 64 can alternatively be eliminated and snap-in plastic inserts utilized to cover engagement surfaces of the slots 30, 32 so that the guide pins 48, 50 engage the inserts within the slots 30, 32. Suitable inserts are disclosed in U.S. patent application Ser. No. 09/492,238, the disclosure of which is expressly incorporated herein in its entirety by reference. It is also noted that the bushings can alternatively be eliminated such that the guide pins 48, 50 directly contact the slots 30, 32.

Figure 8:
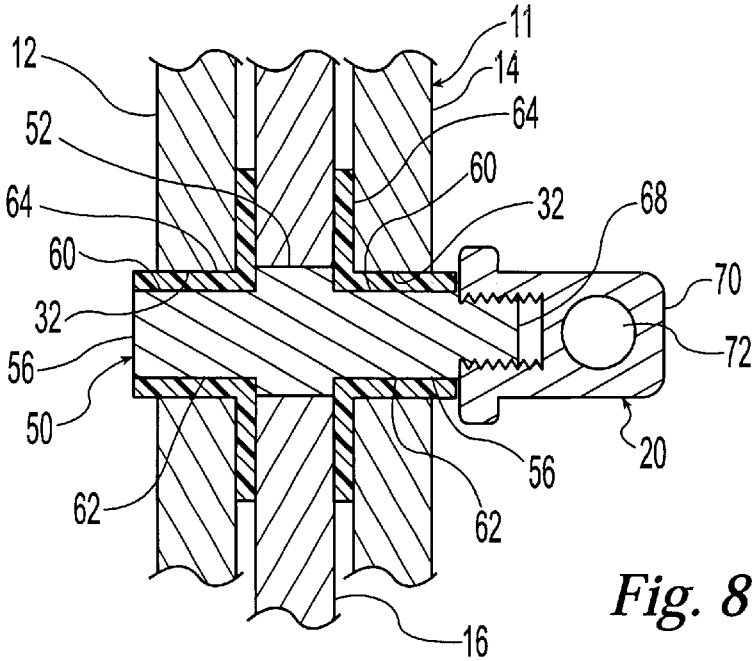
FIG. 8 is a cross-sectional view taken along a lower guide pin of the adjustable control pedal of FIG. 2.

As best shown in FIG. 8, the illustrated lower guide pin 50 is substantially the same as the upper guide pin 48 except that a connection portion 68 extends from one of the end portions 56 and is sized and shaped for cooperation with a drive nut 70 of the drive assembly 20. While the lower guide pin 50 of the illustrated embodiment is directly connected to the drive assembly 20, the upper guide pin 48 can alternatively be directly connected to the drive assembly 20.

As best shown in FIGS. 1 to 6, the central axes of the upper and lower guide pins 48, 50 are preferably horizontally offset, that is, the axes of the upper and lower guide pins 48, 50 are preferably not in the same vertical plane to provide additional stability to the lower pedal arm 16. In the illustrated embodiment; the lower guide pin 50 is located rearward of the upper guide pin 48. The upper and lower guide pins 48, 50 are spaced apart along the length of lower pedal arm 16 a distance adequate to permit sliding of the guide pins 48, 50 along the slots 30, 32. The upper and lower guide pins 48, 50 extend through the slots 30, 32 of the first and second members 12, 14 so that the lower pedal arm 16 is supported by the first and second members 12, 14 by contact of the upper and lower guide pins 48, 50 with bottom bearing surfaces of the slots 30, 32 and the lower pedal arm 16 is movable fore and aft relative to the first and second members 12, 14 as the upper and lower guide pins 48, 50 slide along the bottom bearing surfaces of the slots 30, 32. Each guide pin 48, 50 is in a double shear loading condition because the opposed end portions 56 are supported by the first and second members 12, 14 and the loads are applied to the central portion 52 by the lower pedal arm 16. It is noted that the upper and lower guide pins 48, 50 can engage ends of the slots 30, 32 to provide limits to the movement of the lower pedal arm 16 relative to the first and second members 12, 14 or the drive assembly 20 can provide electronic stops.

The guide slots 30, 32 are preferably sized and shaped such that, as the guide pins 48, 50 travel along the guide slots 30, 32, the pedal 18 moves along a substantially linear horizontal path. The illustrated guide slots 30, 32 are non-parallel and angled downward in a rearward direction, that is the forward end is located higher than the rearward end, to pivot the lower pedal arm 16 as the guide pins 48, 50 travel along the guide slots 30, 32. The orientation of the pedal 18 somewhat changes as it moves along its substantially linear horizontal path. It should be appreciated that by utilizing inclined or angled guide slots 30, 32, the package size of the control pedal 10 can be optimized for a particular motor vehicle. Particularly, the length of the first and second members 12, 14 in the forward/rearward direction can be significantly reduced. This is particularly advantageous in compact or midsize motor vehicles having power steering because the available space for the control pedal 10 below the steering column is limited. It is noted, however, that the guide slots 30, 32 can have other configurations such as, for example, horizontal and parallel so that the lower pedal arm 16 travels in a horizontal path and does not pivot, but there is an increase in the package size of the control pedal 10. It is also noted that in configurations where the lower pedal arm 16 pivots, it may be required in some configurations to have pivotable movement in the drive assembly 20 between the lower pedal arm 16 and the upper pedal arm 11 such as, for example, the lower guide pin 50 pivotable relative to the lower pedal arm 16, the drive nut 70 pivotable relative to the lower guide pin 50, and/or the drive screw 72 pivotable relative to the housing 74 or upper pedal arm 11.

The drive assembly 20 includes a screw shaft or drive screw 72, a drive screw attachment or housing 74 for securing the drive assembly 20 to the upper pedal arm 11, the drive nut 70 adapted for movement along the drive screw 72 in response to rotation of the drive screw 72, an electric motor 76 for rotating the drive screw 72, and a drive cable 78 for operatively connecting the motor 76 to the drive screw 72 and transmitting rotation motion thereto.

The drive screw 72 is an elongate shaft having a threaded portion adapted for cooperation with the drive nut 70. The drive screw 70 is preferably formed of metal such as, for example, steel but can be alternately formed of a plastic resin such as, for example, NYLON. The forward end of the drive screw 72 is journaled by the drive screw housing 74 for rotation of the drive screw 72 by the motor 76. The drive screw 72 rearwardly extends from the drive screw housing 74 generally parallel to and adjacent the lower slots 32 in the first and second members 12, 14 in a cantilevered fashion. Mounted in this manner, the drive screw 72 is generally horizontal. The illustrated drive screw 72 is provided with a bushing 80 for connection to the housing 74 to form a relatively fixed rotating joint. The drive screw 72 can alternatively be connected to the drive screw housing 74 with a self-aligning or freely pivoting rotating joint, that is, a joint which freely permits pivoting of the drive screw 72 relative to the drive screw housing 70 and the first and second members 12, 14 about at least axes perpendicular to the drive screw rotational axis 82. The self-aligning joint automatically corrects misalignment of the drive screw 72 and/or the drive nut 70. The self-aligning joint also allows the lower slot 32 to be nonlinear when desired. The self aligning joint can be, for example, a ball/socket type joint.

The drive screw housing 74 is sized and shaped for supporting the forward end of the drive screw 72 and attaching the drive screw 72 to the first and second members 12, 14. The drive screw housing 74 is preferably molded of a suitable plastic material such as, for example, NYLON but can alternatively be formed of metal such as steel. The illustrated drive-screw housing 72 is secured to the upper pedal arm 11 with a snap-fit connection. It is noted, however, that the drive screw housing 74 can be secured to the upper pedal arm 11 in other suitable manners such as, for example, welding, staking, or mechanical fasteners. The illustrated housing 74 extends through an opening 84 in only one of the first and second members 12, 14 (the second member 12) but alternatively can extend through openings 84 in each of the first and second members 12, 14 to additionally connect the first and second members 12, 14 together.

The drive nut 70 is adapted for axial movement along the drive screw 72 in response to rotation of the drive screw 72. The drive nut 70 is preferably molded of a suitable plastic material such as, for example, NYLON but can alternatively be formed of metal such as, for example steel. The drive nut 70 is rigidly secured to the lower guide pin 50 as described hereinabove. The lower guide pin 50 can be alternatively connected to the drive nut 70 with a self-aligning or freely pivoting joint, that is, a joint which freely permits pivoting of the drive nut 70 relative to the lower guide pin 50 about at least axes perpendicular to the rotational axis 82 of the drive screw 72. The self-aligning joint automatically corrects misalignment of the drive nut 70 and/or drive screw 72. The self aligning joint can be, for example, a ball/socket type joint.

The electric motor 76 can be of any suitable type and can be secured to the firewall or other suitable location such as, for example, the mounting bracket 22. The drive cable 78 is preferably a flexible push-pull cable and connects the motor 76 and the forward end of the drive screw 72 so that rotation of the motor 76 rotates the drive screw 72. It is noted that the drive screw 72 and the motor 76 can be alternatively connected with a rigid connection. An input end of the drive cable 78 is connected to an output shaft of the motor 76 and an output end of the drive cable 78 is connected to an end of the drive screw 72. It is noted that suitable gearing is provided between the motor 76 and the drive screw 72 as necessary depending on the requirements of the control pedal 10. It is also noted that the fixed portion or sheath of the drive cable 78 is rigidly secured to the forward end of the drive screw housing 74 and a rotating portion of the cable 78 is operatively connected to the forward end of the drive screw 72 to rotate the drive screw 72 therewith. See U.S. patent application Ser. No. 09/492,238, the disclosure of which is expressly incorporated herein in its entirety by reference, for a more detailed description of a suitable drive screw, housing, and/or cable support.

Preferably, a controller including processing means and memory means are adapted to control operation of the motor 76. The controller can be a dedicated controller, the motor vehicle control unit, or a controller of another system of the motor vehicle such as, for example, a keyless entry system or a powered seat system. See U.S. patent application Ser. No. 09/492,636, the disclosure of which is expressly incorporated herein in its entirety by reference, for a more detailed description of a suitable control system having a controller.

To adjust the control pedal 10, the driver engages a control switch which activates rotation of the motor 76 in the desired direction. Rotation of the motor 76 rotates the drive screw 72 through the drive cable 78 and causes the drive nut 70 to axially move along the drive screw 72 in the desired direction. The drive nut 70 moves along the drive screw 72 because the drive nut 70 is held against rotation with the drive screw 72 by the lower guide pin 50. As the drive nut 70 axially moves along the drive screw 72, the lower guide pin 50 moves along the lower slots 32 because the lower guide pin 50 is secured to the drive nut 70. It is noted that binding of the drive nut 70 along the drive screw 72 is minimized if a self-aligning joint is provided, between the drive screw 72 and the drive screw housing 74 and/or the drive nut 70 and the lower guide pin 50, to automatically align the components so that the drive nut 70 can smoothly travel along the drive screw 72. As the lower guide pin 50 slidingly moves along the lower slots 32, the lower pedal arm 16 is moved therewith to adjust the forward/rearward position of the pedal 18. As the lower pedal arm moves 16, the upper guide pin 48 slides along the upper slots 30. With such movement, the pedal 18 travels in a substantially linear and horizontal path, that is, the pedal 18 moves in a forward/rearward direction and generally remains at the same height relative to the fixed mounting bracket 22 and the upper pedal arm 11 which does not move relative the mounting bracket 22 during adjustment of the pedal 18. The lower pedal arm 16 pivots as it moves so that the orientation of the pedal 18 slightly changes. This change in orientation of the pedal 18 is typically too small to be detected by the motor vehicle operator. As the position of the pedal 18 is adjusted by rotating the drive screw 72, the upper pedal arm 11 remains in fixed position relative to the mounting bracket 22. It can be seen from the above description that activation of the motor 76 changes the position of the lower pedal arm 16 relative to the upper pedal arm 11 and the position of the pedal relative to the motor vehicle operator but not the position of the upper pedal arm 11 relative to the mounting bracket 22 and therefore does not affect the connection of the upper pedal arm 11 to the control device of the motor vehicle through the booster pin 34.

From the foregoing disclosure and detailed description of certain preferred embodiments, it is apparent that the two-piece upper arm 11 of the present invention reduces packaging space required by prior art designs, improves the load path from the lower arm to the booster pin by reducing the offset between the apply point and the reaction point, increases load capacity by creating a double shear loading condition on the guide pins, and reduces side lash and increases strength of the assembly in cross car loading by increasing rigidity. Additionally, the flat sided guide pins improve load distribution by increasing the contact surface area of the engaging parts and eliminate single point failure by prohibiting adjustment of the pedal upon load application without the drive screw in place. Furthermore, the control pedal of the present invention provides improved ease of manufacturing and assembly because the components are of reduced complexity. For example, the first and second members of the upper arm can be produced by a more cost effective stamping operation. Moreover, cost is reduced because the guide pins perform multiple functions such as spacing apart the first and second members of the upper arm, transferring loads from the lower arm to the upper arm, retaining the polymer bushings, and attaching the drive nut to the lower arm.

From the foregoing disclosure and detailed description of certain preferred embodiments, it is also apparent that various modifications, additions and other alternative embodiments are possible without departing from the true scope and spirit of the present invention. For example, it is apparent to those skilled in the art, given the benefit of the present disclosure, that the guide pins and slots can have many different forms. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. An adjustable control pedal comprising, in combination:

a mounting bracket;

an upper arm having first and second generally planar members, said first and second members being generally parallel and spaced apart;

wherein the upper arm is pivotably attached to the mounting bracket;

a lower arm having a lower end carrying a pedal and an upper end extending between said first and second members and operatively connected to said upper arm for selected movement relative to said upper arm;

a drive assembly operatively connected to the lower arm to selectively move the lower arm relative to the upper arm;

wherein the drive assembly includes a drive screw carried by the upper arm and a nut operably connected to the lower arm and threadably engaging the drive screw to move axially along the drive screw upon rotation of the screw;

wherein the drive screw is located adjacent a side of the second member opposite the first member with the second member positioned between the drive screw and the first member; and wherein the first and second generally planar members are secured together by at least one separate spacer pin extending between the first and second generally planar members.

2. The adjustable control pedal according to claim 1, wherein said first and second members each have at least one slot formed therein and at least one guide pin secured to the lower arm extends into said slot of each of said first and second members.

3. The adjustable control pedal according to claim 2, wherein said first and second members each have first and second slots formed therein, a first guide pin secured to the lower arm extends into said first slot of each of said first and second members, and a second guide pin secured to the lower arm extends into said second slot of each of said first and second members.

4. The adjustable control pedal according to claim 2, wherein said at least one guide pin is provided with bushings extending into said at least one slot of said first and second upper members.

5. The adjustable control pedal according to claim 4, wherein bushings have flanges extending between said lower arm and said upper arm.

6. The adjustable control pedal according to claim 2, wherein said at least one guide pin has planar upper and lower engagement surfaces extending within said at least one slot.

7. The adjustable control pedal according to claim 2, wherein said at least one guide pin extends from said first member to said second member and through said lower arm.

8. The adjustable control pedal according to claim 1, wherein said first and second members are rigidly connected together to prevent relative movement therebetween.

9. The adjustable control pedal according to claim 1, wherein said first and second members are plates.

10. The adjustable control pedal according to claim 1, wherein the spacer pin extends into openings in the first and second generally planar members.

11. The adjustable control pedal according to claim 1, wherein the drive screw is located outside a space located between the first and second generally planar members.

12. The adjustable control pedal according to claim 1, wherein said first and second members are separate components secured together by the spacer pin.

13. An adjustable control pedal comprising, in combination:

a mounting bracket;

an upper arm having first and second spaced-apart members, said first and second members each having a slot formed therein;

wherein the upper arm is pivotably attached to the mounting bracket;

a lower arm having a lower end carrying a pedal and an upper end extending between said first and second members;

a guide pin secured to the lower arm and extending into said slot of said first member and said slot of said second member;

a drive assembly operatively connected to the lower arm to selectively move the lower arm relative to the upper arm;

wherein the drive assembly includes a drive screw carried by the upper arm and a nut operably connected to the lower arm and threadably engaging the drive screw to move axially along the drive screw upon rotation of the screw;

wherein the drive screw is located adjacent a side of the second member opposite the first member with the second member positioned between the drive screw and the first member; and wherein the first and second members are generally planar and a space formed between the first and second members has an open periphery between the first and second members along the entire periphery of the first and second members.

14. The adjustable control pedal according to claim 13, wherein said first and second members each have a second slot formed therein and a second guide pin is secured to the lower arm and extends into said second slot of each of said first and second members.

15. The adjustable control pedal according to claim 14, wherein said second guide pin is provided with bushings extending into said second slot of said first and second upper members.

16. The adjustable control pedal according to claim 13, further comprising bushings encircling said guide pin within said slot of said first member and said slot of said second member and wherein the bushings have flanges extending between said lower arm and said upper arm.

17. The adjustable control pedal according to claim 13, wherein said guide pin has planar upper and lower engagement surfaces extending within said at least one slot.

18. The adjustable control pedal according to claim 17, further comprising bushings encircling said guide pin within said slot of said first member and said slot of said second member and wherein said bushings conform to said planar upper and lower engagement surfaces.

19. The adjustable control pedal according to claim 13, further comprising bushings encircling said guide pin within said slot of said first member and said slot of said second member and wherein said bushings comprise a plastic material.

20. The adjustable control pedal according to claim 13, wherein said first and second members are rigidly connected together to prevent relative movement therebetween.

21. The adjustable control pedal according to claim 13, wherein said first and second members are substantially parallel plates.

22. The adjustable control pedal according to claim 13, wherein said guide pin extends from said slot of said first member to said slot of said second member and through said lower arm.

23. The adjustable control pedal according to claim 13, wherein the first and second generally planar members are secured together by at least one separate spacer pin extending between the first and second generally planar members.

24. The adjustable control pedal according to claim 23, wherein said first and second members are separate components secured together by the spacer pin.

25. The adjustable control pedal according to claim 13, wherein the drive screw is located outside a space located between the first and second generally planar members.

26. An adjustable control pedal comprising, in combination:

a mounting bracket;

an upper arm having first and second spaced-apart members, said first and second members each having first and second slots formed therein;

wherein the upper arm is pivotably attached to the mounting bracket;

a lower arm having a lower end carrying a pedal and an upper end extending between said first and second members;

a first guide pin secured to the lower arm and extending into said first slot of said first member and said first slot of said second member;

a second guide pin secured to the lower arm and extending into said second slot of said first member and said second slot of said second member;

a drive assembly operatively connected to the lower arm to selectively move the lower arm relative to the upper arm;

wherein the first and second members are generally planar, separately formed and rigidly secured together by at least one separate spacer pin extending between the first and second generally planar members;

wherein the drive assembly includes a drive screw carried by the upper arm and a nut operably connected to the lower arm and threadably engaging the drive screw to move axially along the drive screw upon rotation of the screw; and wherein the drive screw is located adjacent a side of the second member opposite the first member with the second member positioned between the drive screw and the first member.

* * * * *